US007926675B2

(12) United States Patent
Rieck et al.

(10) Patent No.: US 7,926,675 B2
(45) Date of Patent: Apr. 19, 2011

(54) FIXING THE POSITION OF A PULL-TAB WITH AN ANTI ROTATION BEAD FORMED FROM THE PANEL

(75) Inventors: Hajo Rieck, Grafschaft (DE); Richard Chalk, Flintshire (GB); Martin Gray, Flintshire (GB)

(73) Assignee: Ball Packaging Europe GmbH, Ratingen (DE)

( * ) Notice: Subject to any disclaimer, the term of this patent is extended or adjusted under 35 U.S.C. 154(b) by 1233 days.

(21) Appl. No.: 10/541,845

(22) PCT Filed: Dec. 23, 2003

(86) PCT No.: PCT/DE03/04283

§ 371 (c)(1),
(2), (4) Date: Jun. 27, 2006

(87) PCT Pub. No.: WO2004/065034

PCT Pub. Date: Aug. 5, 2004

(65) Prior Publication Data

US 2007/0062950 A1 Mar. 22, 2007

(30) Foreign Application Priority Data

Jan. 13, 2003 (DE) ..... 103 00 914
May 5, 2003 (DE) ..... 103 19 971

(51) Int. Cl.
*B65D 17/34* (2006.01)
*B21D 31/00* (2006.01)
*B21D 51/44* (2006.01)

(52) U.S. Cl. ..... 220/269; 220/906; 220/270; 413/12; 72/379.2

(58) Field of Classification Search ..... 220/269, 220/270, 906; 413/12, 16, 17; 72/379.2
See application file for complete search history.

(56) References Cited

U.S. PATENT DOCUMENTS 3,191,564 A 6/1965 Fraze
3,381,848 A 5/1968 Brown
(Continued)

FOREIGN PATENT DOCUMENTS

DE 2100580 8/1970
(Continued)

OTHER PUBLICATIONS

Office Action for U.S. Appl. No. 10/541,846, mailed Apr. 11, 2007.
(Continued)

*Primary Examiner* — Robin Hylton
(74) *Attorney, Agent, or Firm* — Sheridan Ross P.C.

(57) ABSTRACT

The invention relates to a positional fixing of a tab on a sheet metal lid comprising a panel (10) and a seamable edge (12) surrounding said panel, suitable for attaching to a can body. On the panel (10), an openable area is defined by a weakening line (16), and outside said openable area (17), a tab (30,31, 32,33) is provided at a mounting place (11). Said tab (30) comprises a grip portion (32), an opening portion (33), and an attaching portion (31), said latter being provided for attaching said tab substantially parallel with respect to said panel (10). Said tab (30) as attached is disposed with its opening portion (33) above said openable area (17). Close to at least one edge (31*c*) of the attaching portion (31), a strip-shaped projection (21*a*, 21*b*, 20) is shaped to protrude out of said panel (10), for limiting a pivoting movement (α) of said tab (30) around said mounting place (11).

21 Claims, 4 Drawing Sheets

U.S. PATENT DOCUMENTS

| | | | |
|---|---|---|---|
| 3,749,275 | A | 7/1973 | Smith, Jr. et al. |
| 3,780,902 | A | 12/1973 | Holc et al. |
| 3,782,586 | A | 1/1974 | Brown |
| 3,785,522 | A | 1/1974 | Prayer et al. |
| 3,812,803 | A | 5/1974 | Brown |
| 3,868,918 | A | 3/1975 | Smith, Jr. et al. |
| 3,871,314 | A | 3/1975 | Stargell |
| 3,929,252 | A | 12/1975 | La Croce |
| 3,941,276 | A | 3/1976 | Patel |
| 3,967,754 | A | 7/1976 | Ostrem |
| 4,148,410 | A | 4/1979 | Brown |
| 4,416,389 | A | 11/1983 | Wilkinson et al. |
| 4,455,114 | A | 6/1984 | Zysset |
| 4,535,909 | A | 8/1985 | Zysset |
| 4,596,342 | A | 6/1986 | Zysset |
| 4,826,037 | A | 5/1989 | La Croce |
| 5,129,541 | A | 7/1992 | Voigt et al. |
| 5,494,184 | A | 2/1996 | Noguchi et al. |
| 5,799,816 | A | 9/1998 | Schubert |
| 5,918,499 | A | 7/1999 | Langlasse et al. |
| 7,165,926 | B2 | 1/2007 | Rieck et al. |
| 7,384,227 | B2 | 6/2008 | Rieck et al. |
| 2006/0016815 | A1 | 1/2006 | Rieck et al. |

FOREIGN PATENT DOCUMENTS

| | | |
|---|---|---|
| DE | 7018731 | 8/1970 |
| DE | 2008138 | 9/1971 |
| DE | 7127606 | 10/1971 |
| DE | 2024535 | 12/1971 |
| DE | 7212780 | 8/1972 |
| DE | 2256498 | 11/1972 |
| DE | 7227762 | 11/1972 |
| DE | 2260375 | 6/1974 |
| JP | 08-053131 | 6/1996 |
| JP | 09-226762 | 9/1997 |

OTHER PUBLICATIONS

Office Action for U.S. Appl. No. 11/089,591, mailed Aug. 18, 2009.
Office Action for U.S. Appl. No. 11/089,591, mailed Jun. 7, 2007.
International Preliminary Examination Report (including translation) for International (PCT) Patent Application No. PCT/DE03/04283, completed Oct. 19, 2004.
Notice of Allowance for U.S. Appl. No. 10/541,846, mailed Dec. 26, 2007.
Supplemental Notice of Allowability for U.S. Appl. No. 11/184,007, mailed Nov. 17, 2006.
Office Action for U.S. Appl. No. 11/184,007, mailed Feb. 6, 2006.
Notice of Allowance for U.S. Appl. No. 11/184,007, mailed Sep. 5, 2006.
Office Action for U.S. Appl. No. 11/089,591, mailed Feb. 6, 2009.
Office Action for U.S. Appl. No. 11/089,591, mailed Jul. 15, 2008.
Office Action for U.S. Appl. No. 11/089,591, mailed Dec. 26, 2007.
Office Action for U.S. Appl. No. 11/089,591, mailed Sep. 11, 2006.
International Search Report (including translation) for International (PCT) Patent Application No. PCT/DE03/04283, mailed Aug. 2, 2004.
Container Manufacturing Standard EO-27, 63mm DIA EO. 27 END, Mar. 10, 1983, p. 1.
Container Manufacturing Standard EO-38, 209 DIA E.O. 38 END, Jul. 9, 1981, p. 1.
Container Manufacturing Standard EO-41, 50mm DIA EO 41 END, Mar. 18, 1987, p. 1.

(*) here or in the station of Fig. 2

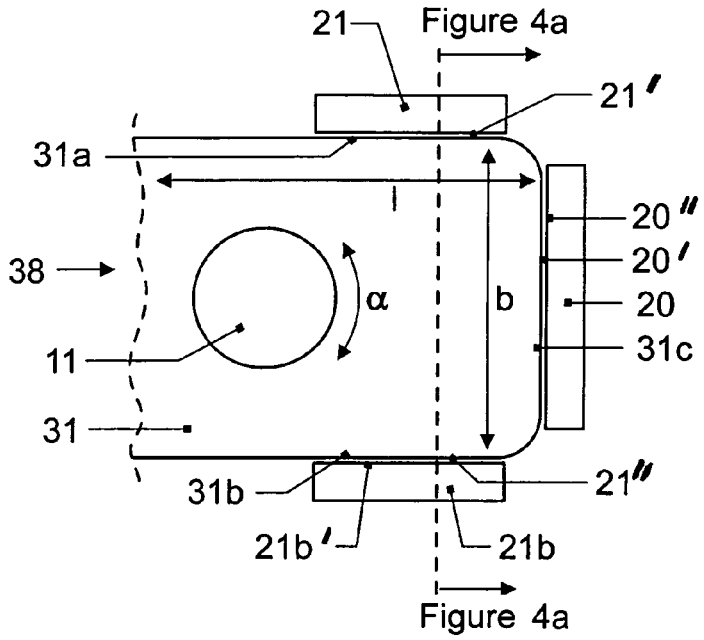
Figure 4
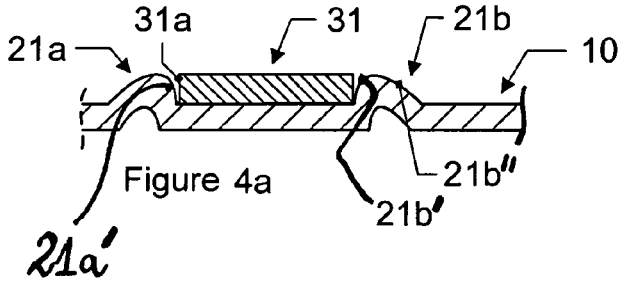
Figure 6
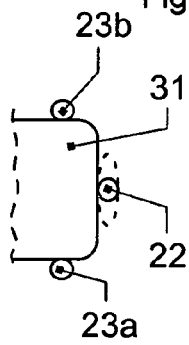
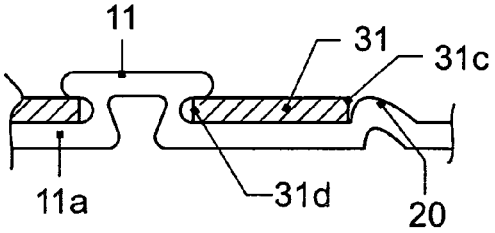
Figure 5a
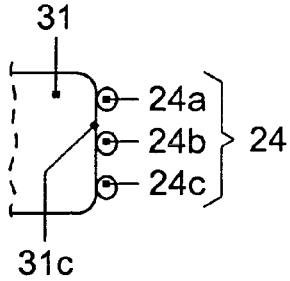
Figure 7
Figure 5
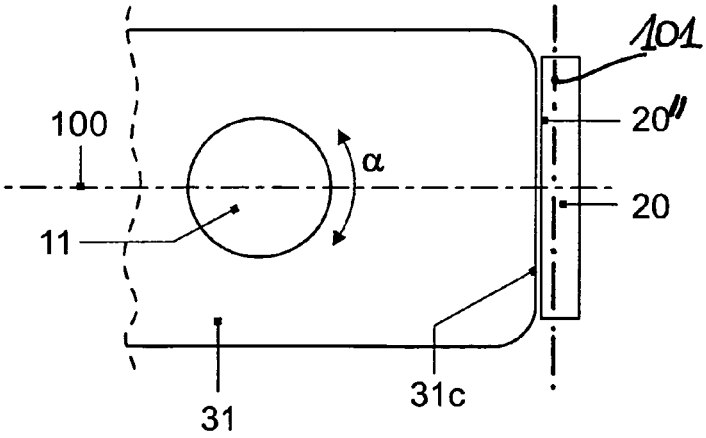

$$\ell_1 > \frac{\ell}{2}$$

$$\frac{b}{2} \approx b_1$$

FIXING THE POSITION OF A PULL-TAB WITH AN ANTI ROTATION BEAD FORMED FROM THE PANEL

The invention relates to the provision of a positional fixing of a tab on a sheet metal lid for attaching to a body of a beverage can.

When the tab is in an attached condition to the sheet metal lid, it is known by the expert as a SOT (Stay on Tab), which is provided for opening an openable area in the surface of a lid (usually designated as "panel"). For this purpose, the tab is taken at a grip end and raised with a vertically orientated tilting motion for breaking open an openable area along a line of weakness (usually called score line) with its opening end.

Particularly with large opening ends (LOE) as openable area, difficulties are encountered in the related art with regard to fixing the positions of the tab in an attached condition to the sheet metal lid. Suggestions on this topic have already been made, for example in U.S. Pat. No. 5,799,816 (Schubert). In said document, an opening of an attaching portion of the tab is proposed, which attaching portion is usually designated as "rivet island". Said attaching portion is secured to the panel of the sheet metal lid through a shaped rivet and overlaps a round to elongated reformed bead with an opening provided in the attaching portion, which bead may also be formed after attaching the tab, compare column 3, lines 63-67, column 5, lines 37-44, claim 3 of said document and the associated graphical illustration in FIGS. 2 and 4 thereof.

The invention addresses the technical problem of achieving such effect, but with an improved manufacture and reliability of the anti-rotation block and with an improved positional alignment of the tab in the attached condition.

According to the invention, it is suggested not to allow the projection to protrude through an opening of the attaching portion, and that the attaching portion not be provided with an opening for this purpose beforehand, but to keep the attaching portion entire and to provide a blocking means that acts on the attaching portion from an outside.

In order to obtain the blocking effect, which can also be a limiting effect, which is to be understood to range from a complete prevention of a rotating movement up to a substantial limitation of said rotating movement, an outer edge of the flat attaching portion (rivet island) is stopped by abutting against the projection that is shaped to protrude out of the sheet metal lid. Since the projection has positional stability on the panel in all operating positions, also when starting to break open the openable area, and since the attaching portion itself is substantially coplanar with the panel of the lid, tightly surrounding the central rivet as a mounting place, none of the elements provided for preventing rotation operationally moves apart with an opening movement of the tab. Since the opening movement is a vertical tilting motion, anti-rotation is unaffected due to an outer edge of the attaching portion abutting on the panel projection.

Advantageously, a peripheral edge on a usual tab already provided during manufacturing may also be used, said edge not having to be specifically formed additionally for obtaining the rotation barrier after an attachment of the tab to the panel ("staking"). The only influencing takes place on the sheet metal lid itself, which is provided with a shape or molding, as the rivet is in a preliminary phase, which shape or molding may preferably also be pre-formed in parallel together with the formation of the rivet and subsequently be modified in shape, or more precisely "reformed", in a further processing step of the sheet metal lid being manufactured. The projection may thus be formed integrally with the sheet metal lid, like the mounting place is formed by one-piece manufacturing for the attaching portion of the tab.

The projection can have strip shape (line shape) and be preferably orientated at least one of transversely and in parallel to a longitudinal extension of the tab (longitudinal axis or longitudinal plane), said projection engaging at a correspondingly orientated peripheral edge of the attaching portion for its blocking effect or being provided very closely adjacent thereto. In a longitudinal extension, said projection can extend over more than 30%, preferably over more than 50% to more than 80% of the width of the attaching portion.

If the projections extend parallel to the longitudinal extension of the tab, that is to say perpendicularly to the transverse direction mentioned before, the longitudinal extension is shorter than the longitudinal extension of the attaching portion (rivet island) of the tab, preferably at a position as distant as possible from the mounting place having a large distance therefrom, said distance, however, only being such large that at least one portion of the two peripheral lines abuts blockingly on the at least one projection when starting a rotating movement.

Making the attachment as distant as possible from the mounting place allows the greatest possible force be exerted, which provides a blocking effect in opposition to inadvertent or deliberate rotation of the tab by a user. Particularly, the projections oriented parallel to the longitudinal extension of the tab apply a great force for the blocking effect. All three may also be used in combination.

Regarding the height or vertical extension of the at least one projection, it should be noted that said height should be at least equal to the thickness of the sheet metal of the attaching portion, preferably slightly to markedly greater in order to obtain a reliable positional fixing that, however, is not impaired by operating or raising the grip portion, since the attaching portion is reliably situated on the other side of the mounting place and coplanar with the panel section surrounding the rivet (button coin area).

Several projections can be provided, not all projections having to be associated with the same outer edge portion of the attaching portion. The projections can also be differently shaped, i.e. strip-shaped, round to oval, or a combination thereof. If a straight-lined outer edge portion of the attaching portion is provided, a straight-lined (strip-shaped) design of the projections can be advantageous. Said straight-lined or linear strip design can also be achieved by arranging at least two punctiform projections in line, which then form a group that is associated with the same outer edge portion of the attaching portion.

The attaching portion in the form of a mounting tongue is connected to the rest of the tab via a buckling portion in the form of an articulation line, i.e. integrally. It is thus provided between the opening portion (the rupture nose) and the grip portion that is preferably provided with a hole.

If the attaching portion is substantially rectangular, the substantially rectangular, flat, attaching portion is formed by using the articulation line and three edge lines. Particularly, said flat or surface portion is square in shape, the rivet head not being central after mounting, but positioned closer to the articulation line. The distance of the outwardly directing peripheral edge is therefore larger than half the longitudinal extension of the attaching portion, so that a correspondingly improved force effect is achieved, when a projection on the panel can be assigned to the peripheral edge most distant from the mounting place.

Forming at least one projection to have an asymmetrical cross section is particularly advantageous, said projection having a steeper flank facing the attaching portion, than the flank facing away from said attaching portion. Such a shape can also be selected for punctiform or oval projections.

In a subsequent reshaping, reforming, or post-forming, preferably the thickness of a top side of the (strip-shaped) projection is reduced. Thereby, solidification of said portion as well as of the projection as a whole is achieved. This also applies to the method. The score line may be applied simultaneously with said reforming, in the same processing step.

The result of said reforming is optically visible in a flattened top side. The projection thus formed has a larger width than its total height. Even larger is the respective longitudinal extension of a projection, said longitudinal extension being considerably larger than the width of the projection. This applies to elongated strip-shaped or linear projections. When a steeper flank portion is formed, which is markedly more pronounced than the preform, a peripheral edge may be obtained having (at least) one portion extending at an angle of substantially 90° relative to the plane of the panel. This applies to the edge opposing the assigned peripheral edge portion of the attaching portion. An embossing process also helps to give a stronger or steeper shape to said flank, said embossing being responsible for the reinforcement of the reformed sheet metal on the top side.

When several projections are provided in the aforementioned sense, they do not have to engage at the same edge line of the attaching portion when starting a rotating movement, but instead they can be assigned to different outer edges.

If one assumes a still unfinished sheet metal lid that is only being prepared to receive a tab, the invention claimed here includes the formation of the projection in such a position that is sufficiently distant from the intended mounting place (from the re-formed rivet or its preform), and in fact at such a distance that the outer edge in the form of an edge of the attaching surface (rivet island) facing away from the future rivet is located very close to the projection, thereby achieving the rotation stopping effect. Said location is in the outer edge portion of a rivet head zone or of the "rivet base", which extends visibly around the formation of the rivet centre remaining from the rivet preform.

The projection as a line or strip lies at least partially outside the weakened rivet base portion, in which the sheet metal is thin due to the shaping of the mounting place. This addresses a peripheral portion of said rivet base zone, preferably more than 40% of an assumed surface of a strip-shaped projection lying outside the rivet base zone.

For a definition of the rivet base zone, reference may be made to a visible change of the surface that remains on the inside of the sheet metal lid after the rivet has been formed and the tab has been mounted. Due to being placed in the outer portion, i.e. as distant as possible from the weakened sheet metal or the thin sheet metal, the re-formed portion may be considerably higher before the sheet metal is damaged. The re-forming may achieve heights that are above a sheet metal thickness of the attaching portion of the tab.

When providing a strip-shaped projection, it can be designed to have a length larger than the diameter of the finished rivet head.

The attaching portion being formed from a piece of the central portion of the tab, only minor gaps are visible between the attaching portion, which is displaced downwards to a lower plane by a double buckling line, and the somewhat higher, parallel plane of the remaining tab. Accordingly, the mounting of the projections on at least one of the free peripheral edges facing outward from the attaching portion is barely or only hardly visible from the outside, so that the rotation blocking is virtually invisible to the observer. A colored tab is not changed further in its colored appearance.

Exemplary embodiments explain and supplement the invention.

Figures 1, 2, 3:
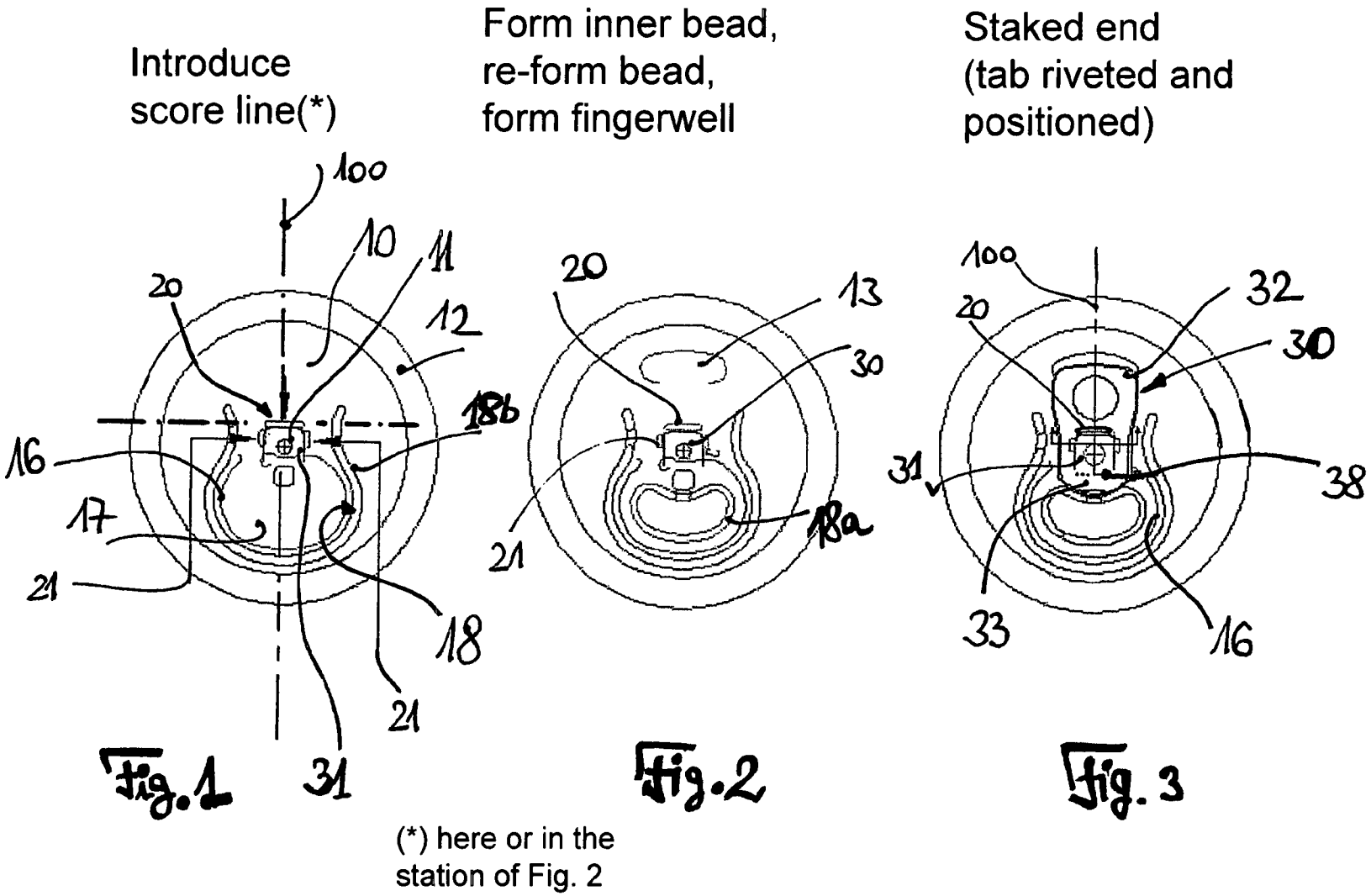
FIG. 1 shows a station for inserting a weakening line 16.
FIG. 2 shows a station for introducing a finger depression 13 and additional beads 18*a* in the openable area inside the weakening line.

FIG. 3 shows a station at which a tab 30 is mounted using a rivet 11 integrally formed on the sheet metal lid, via an attaching portion 31 that is shown schematially as a flat attachment tongue.

FIG. 4 is an enlarged section from FIG. 3, particularly showing the attaching portion 31 and the rivet 11 as mounting place.

FIG. 4*a* is a cross section along line C-C in FIG. 4.

FIG. 5 is an alternative configuration for the positional fixing of the attaching portion 31 and thus of the entire tab 30.

FIG. 5*a* is a sectional view through the centre plane of FIG. 5, alternatively through the vertical longitudinal plane 100 of FIG. 3.

FIG. 6 is an alternative design of projections for blocking rotation of the tab.

FIG. 7 is another alternative design to FIG. 6.

Figure 8:
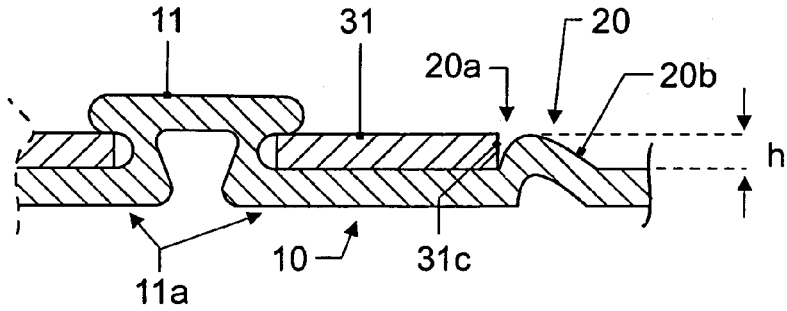

FIG. 8 is a cross section along a longitudinal plane 100, to illustrate a sharp front edge 20*a* of a strip-shaped or line-shaped projection 20.

Figure 8A:
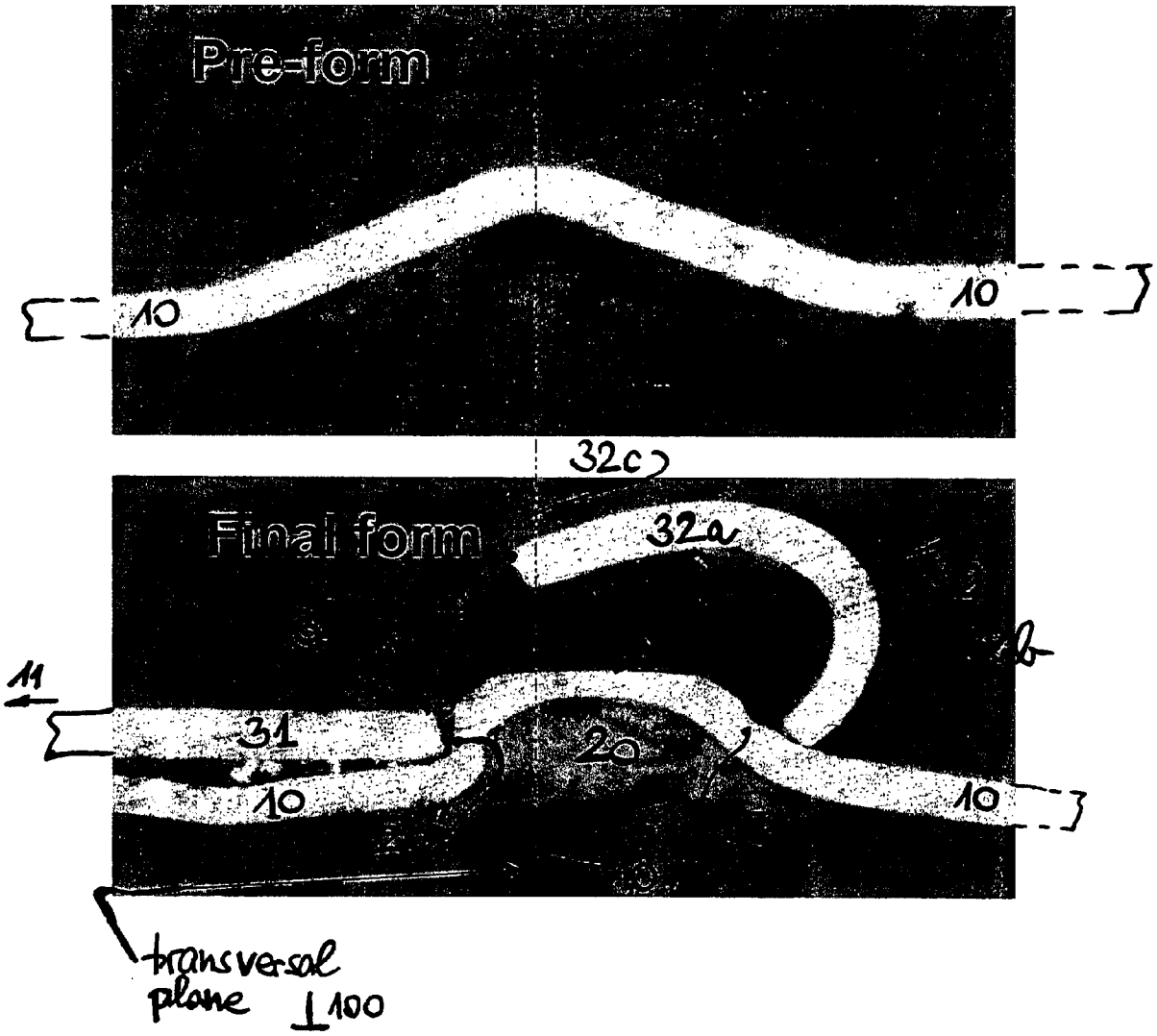

FIG. 8*a* is a cross section of an embodiment of the invention corresponding to the illustration in FIG. 8.

Figure 9A:
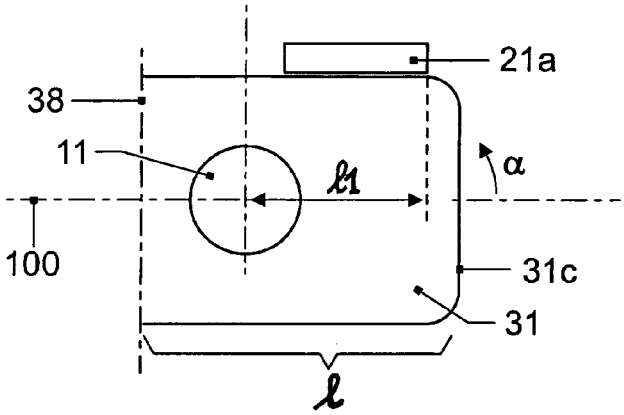

FIG. 9*a* is a schematic explanation of the effective torques in a projection extending parallel to the center plane 100.

Figure 9B:
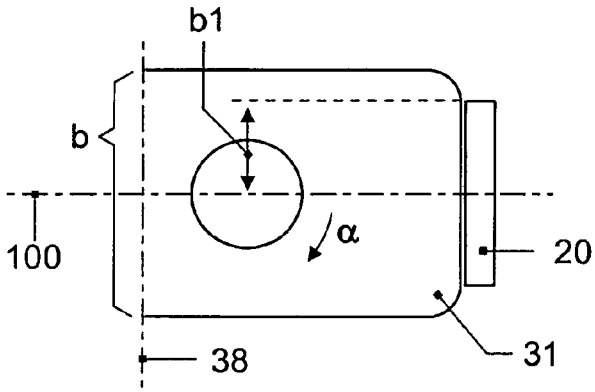

FIG. 9*b* is a comparable explanation of the effective torques in a projection 20 located transversely to the center plane 100.

Figure 10:
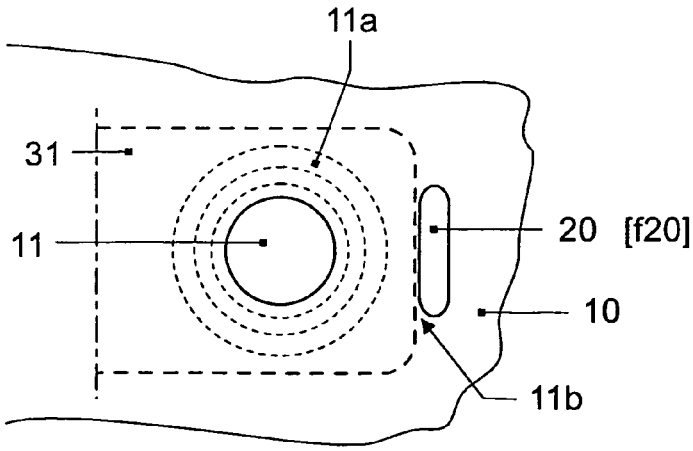

FIG. 10 is an illustration of a portion 11*a* around a rivet 11, said portion being visible from the inside of the lid, a projection 20 being visible as an outwardly vaulted cavity. This figure identifies only a section around the rivet 11 as mounting place.

The sheet metal lid obtained according to FIGS. 1 to 3 has a visible edge portion 12 that is suitable for seaming to the body of a beverage can. The sheet metal lid itself is produced from thin sheet metal, typically less than 0.24 mm, and has already passed through preceding workstations before reaching the stage shown in FIG. 1. Said lid comprises an inner surface portion (panel) 10 surrounded by a seamable edge 12. Within said panel 10, a weakening line 16 is provided around an openable area, said openable area being surrounded by a substantially U-shaped bead 18. Within said bead, which opens towards the centre portion of the panel, the substantially O-shaped weakening line 16 is designed as a score line, having a transitional section that is not scored and thus serves as a connecting portion to the rest of panel 10, when said openable area 17 is broken in along said score line 16 by the effect of a tab, which will be explained later.

A mounting place 11, which will be seen more clearly lateron in the sectional enlargements, is provided approximately in the middle of the panel. An attaching portion as a sheet metal tongue 31 is associated schematically therewith, said attaching portion being part of the tab according to FIG. 3, on which it is formed integrally via an articulation line as a buckling line 38. Said tab 30 comprises a grip portion 32, provided here with a circular opening, at which the tab is operated by the user for breaking open said score line 16 according to FIG. 1. Said tab 30 also comprises an opening portion 33 in front of said attaching portion 31, said opening portion being located as a rupture nose above said openable area 17, for which purpose an additional, eyeball-shaped bead 18*a* as shown in FIG. 2 is provided in a separate working step, said bead reinforcing the transverse LOE openable area, for being able to apply the opening forces to the rupture starting portion (arcuate end of the score line 16). The mounted tab 30 is substantially parallel to the panel, which itself does not have to be designed exactly in one plane, but may be slightly bulged, though the area around said mounting place 11 is substantially planar, allowing a substantially parallel arrangement of the attaching tongue 31 of said tab 30.

For a general survey, the longitudinal midplane 100 is marked, extending in a direction to the longitudinal extension of the tab 30. A transverse plane 101 extends perpendicularly thereto.

As attached (staked end), the grip portion 32 of the tab overlaps a finger depression 13, which is provided in the panel 10, at about the same distance as the inner reinforcing bead 18*a* on the other side of mounting place 11. The tab is attached during the manufacture of the finished sheet metal lid, only in FIG. 3. Beforehand, the mounting place is initially formed as a bubble to permit the attaching portion 31 of the tab 30 to be attached to the panel. According to FIG. 1, three strip-shaped projections are re-formed as upwardly protruding beads (i.e. towards the outside of the sheet metal lid) around said mounting place 11. The bead 20, extending transversely to said midplane 100, is longer than the two neighboring beads, which extend parallel to said midplane 100. They are illustrated for purposes of clarification by 21*a*, 21*b* in FIG. 4, as also the longer bead 20 is represented in more detail there in relation to the attaching tongue 31.

The attaching tongue 31 is shown in FIG. 1, only for illustrating the distances of the beads from the mounting place 11, but at this point is not yet mounted on the sheet metal lid. At the subsequent manufacturing station, the re-forming of the three beads 20, 21*a*, 21*b* is improved or designed more exactly. Said "re-forming" results in a formation of the beads (projections) as used later for the positional fixing according to FIG. 3 and the figures described hereinafter. At said station, said projections receive their correct profile geometries, after having been re-formed integrally from the sheet metal lid (the panel), and extending in a vertical direction h at least to a height that corresponds to the sheet metal thickness of the attaching portion 31 of the tab 30.

In FIG. 3, said tab 30 is added, is placed over the rivet shaft, which is provided with a rivet head in a forming process, which rivet head is illustrated with a larger diameter than in the previous FIGS. 1 and 2. With said rivet head forming, the tab 30 is attached to the panel via the attaching portion 31, said attaching portion being connected to the rest of tab 30 through a buckling line 38. The opening section 33 is located above the openable area inside the score line 16, close to the additional stiffening bead 18*a*.

In order to ensure the rupture force and the accuracy of the breaking-open process, the tab 30 shall not be adapted to move in a rotation direction, which is designated by α in FIG. 4.

It is obvious that the front nose end of the opening portion 33 would be moved away from the exact position that is provided to ensure the rupture force, the continued tearing and the subsequent complete opening of the opening area 17. It is therefore desirable according to FIG. 4, to ensure the movement a to be as minimal as possible, preferably to prevent it even entirely. In this respect, three strip-shaped projections 21*a*, 21*b* and 20 were provided according to FIGS. 1, 2 and 3, said projections being assigned to the three free peripheral edges 31*a*, 31*b*, 31*c* of the attaching portion 31 of the grip portion 30. A small gap 21', 21" and 20' may be left between each outwardly facing edge and the respective inner edge of each projection, for example, between 31*c* and 20" at projection 20. However, the gap may also be reduced to zero on at least one of the outwardly facing edges of said attaching portion 31.

The width of the attaching portion 31 is marked with "b", so that the minimum distance of the two projections 21*b*, 21*a* designed as beads and extending parallel to the longitudinal midplane 100 have this dimension with their inside edges 21*b*' and 21*a*' as distance. The longitudinal extension of the attaching portion 31 in said plane 100 extends over the rivet head as mounting place 11. It is evident that the length of the two beads 21*a*, 21*b* is shorter than half the longitudinal extension of the attaching portion 31, and that said beads are positioned as far as possible to the rear area of the attaching portion in order to apply the greatest possible force for positional fixing at an assumed rotation α.

This also results from the greatest possible distance of the projection 20—disposed in the transverse plane 101—transversely to the longitudinal mid-plane 100, said projection being longer than the two previously described parallel projections. Said projection extends over more than half, preferably even more than 80% of width b of the attaching portion 31.

According to non-illustrated embodiments, one or more of the three described strip-shaped beads may also be omitted Thus for example, a geometry with only one projection 20 is possible, as illustrated in FIG. 5. According to this embodiment, the outwardly facing edge 31*c* that is located most distantly from the rivet is arranged close to said strip-shaped geometry 20, so that a rotational movement a can substantially be prevented in this case too, or at least limited to such an extent that the opening behavior is not affected when the tab 30 is tilted upwards at the grip portion 32. The rotating movement α is therefore limited, completely prevented, or predetermined by at least two limit values, which are defined by the abutment in an assumed rotation α (in both directions about the axis of the rivet 11). The rotating or pivoting movement is substantially in the plane in which the panel is disposed in an area surrounding the rivet head 11, which plane is also kept plane-parallel by the attaching portion 31, which has a planar or surface extension. In the illustrated embodiment as a rectangle, particularly a square, the portion 31 has two parallel peripheral edges or edges 31*b*, 31*a* and one peripheral edge 31*c* at a distance from the articulation line 38 and extending parallel thereto. Another configuration of the attaching portion is also imaginable, said portion having an arcuate form, a triangular shape, or a more distant, not straightly extending peripheral edge 31*c*.

The cross-section shown in FIG. 4*a* relates to the corresponding sectional line of FIG. 4. According thereto, an asymmetrical design of the strip-shaped projections 21*a*, 21*b* is provided, a steeper flank 21*b*' being located closer to a peripheral edge 31*b* than the less steep flank 21*b*" of the strip-shaped projection 21*b*. The same is valid for the parallel projection 21*a* and its associated peripheral edge 31*a*.

In FIG. 4*a*, the sheet metal lid in the panel 10 and the attaching portion 31 are parallel, with the rivet 11 not being visible here. An assumed rotation causes the peripheral edge 31*a* to abut on the steeper flank of the projection 21*a* and the peripheral edge 31*b* to abut on the steeper flank 21*b*' of the projection 21*b*. A narrower association of the steeper flanks, due to their almost vertically extending ridges or steps, permits any minor (residual) rotating movement in the plane of the sheet metal lid of the panel 10 in the rivet zone 11 to be prevented almost completely.

FIG. 5*a* also shows a cross section relating to FIG. 5 and going through a longitudinal plane 100. Said illustration shows the described situation for only one projection 20 cooperating with the peripheral edge 31*c* of the attaching portion 31 to prevent function-affecting rotational movements α. In FIG. 5*a*, the rivet head designed as a mounting place 11 is visible through an opening in the attaching portion 31. Also visible is the allocation of the free peripheral edge 31*c* to the projection 20 re-formed from the metal sheet lid, which projection—as FIG. 4*a* indicates for the other projections 21*b*, 21*a*—may also have an asymmetrical shape.

The asymmetry in a transverse direction to the longitudinal extension of the projection 20 (in the longitudinal plane 100 of the lid or the tab) is illustrated in FIG. 8, with reference to said projection 20, said projection being associated to the peripheral edge 31*c* of the attaching portion 31. By a double forming process, a first pre-forming according to FIG. 1 and a second re-forming according to FIG. 2, a very steep front edge 20" or 20*a* can be obtained, having a very large height h (relative to the thickness of the sheet metal), nevertheless keeping the sheet metal lid undamaged, to which effect contributes that the projection is disposed as distant as possible from the sensitive area of the rivet base 11*a*. The steep front edge 20*a* (or 20" according to FIG. 4), together with a less steeply extending second flank 20*b*, which does not provide a blocking effect with the attaching portion 31, allows higher forces to be applied, and the attaching portion 31 is less likely to be deformed upwards (perpendicularly to the plane of panel 10) on a more flatly extending peripheral edge and to thereby lose the blocking effect.

This is illustrated in FIG. 8*a*, in which a realization is shown in cross section, the cross section extending in a longitudinal direction, as determined by the longitudinal midplane 100, for example according to the representation of FIG. 5 and—practically realized—corresponding to the schematic illustration of FIG. 8. Insofar as reference numbers of FIGS. 4, 5 and 8 indicate the corresponding sections and parts there, they are taken over in the realization according to FIG. 8*a*, in this case in the bottom illustration. The top illustration shows a preform 20*, which is obtained in a two-stage manufacturing process prior to the second step (post-forming or re-forming). In a first shaping step, for example according to FIG. 1, a pre-form 20*, which has a rather rampart- or ridge-shaped structure, is shaped to protrude out of a panel 10 with two flat inclines and an extremely rounded middle portion. In a second re-forming step, for example according to FIG. 2, a much steeper front edge 20" (according to FIG. 4) or 20*a* according to FIG. 8 is obtained, the sheet metal lid nevertheless remaining undamaged. Said second re-forming and the result after attaching the grip portion are shown in the lower illustration of FIG. 8*a*. It is understood that in both the upper and the lower illustrations, the strip-shaped projection 20 extends perpendicularly to the paper plane, in a transverse plane 101 extending perpendicularly to the longitudinal midplane 100. Said transverse plane 101 is a relative indication referring to the position of the pre-form 20*, in which there is a symmetry of the pre-form initially shaped from the sheet metal lid relative to the plane 101, but which is then abandoned during re-forming, as is illustrated by the finished projection 20 in the bottom representation, in which it is no longer symmetrical to the transverse plane 101.

The following embodiments refer to the bottom illustration. The rivet 11 that is used for mounting the attaching portion 31 to the sheet metal lid 10 is located to the left, not in the representation. A rear end 31*c* of the attaching portion 31 is the peripheral edge that is assigned to a front edge 20" of a projection 20, possibly leaving a narrow gap 20', as is explained by FIG. 4. Said projection 20 is characterized by an asymmetry, with a sharp front edge 20" (or 20*a*) and a less steeply extending peripheral edge 20*b* facing outwards. As a result of re-forming, said projection has additionally received a plateau-shaped top side 20*c*, enabling said projection to reach a very large height h relative to the thickness of the sheet metal, despite the relatively flat appearance of its shape.

However, the width of said projection is designed considerably more strongly, said width being larger than the height h, particularly about twice as wide as it is high, the essential portion of said projection 20 being situated to the right of the transverse plane 101.

Said re-forming step comprises a designing shaping of the pre-form 20* with a coining (an embossing operation) for further flattening the top surface 20*c*. In said re-forming process, the tool is applied likewise from the top and from the bottom for said re-forming. The slight bend that is detectable on the left in the rising flank of the pre-form 20' may be recognized in the bottom final form, the way in which the sharp front edge 20" is introduced in the initially gently rising front incline of the shaped rampart 20* also being visible. To the right of the transverse plane 101, the second incline of the rampart is formed from bottom to top, for forming a flat shape 20*c*, starting approximately at the instep of said rampart 20* and leading gently over to the rest of the sheet metal panel 10 in portion 20*b*.

Additionally, in the final form, the attaching portion 31 and the tab 30 are already attached according to FIG. 3, also in a sectional view. The tab is arranged with its intermediate web between the left opening and the grip opening 32*b* substantially above the transversely extending projection 20. Said two openings of the tab are shown in FIG. 3, one opening resulting from the formation of the attaching portion 31, which is further connected to the tab 30 via an articulation line 38, whereas the opening for inserting a finger is designed particularly. Said opening 32*b* forms part of the grip portion 32, the web 32*a* between said two openings being shown slightly bulged in FIG. 8*a*, having a front edge 32*c* that was related to the free edge 31*c* of the attaching portion 31 during manufacture. A major part of the projection 20 is thus located below said web and is barely visible from outside.

In this context, a modified sequence of the two-stage re-forming may be performed besides the processing sequence according to FIGS. 1 to 3, for example the initial introduction of the pre-forms, as illustrated by the pre-form 20* in the top picture of FIG. 8*a*, in a first working step, still without the introduction of score lines (as weakening lines), of which weakening line 16 is an example. In this case—if multiple projections are used to block rotating movements—all pre-forms are shaped. The first score line is then introduced jointly in a single working step, in which the re-forming (further shaping) of the pre-formed projections takes place. In said step, the projections receive their correct, assigned profile, as is shown in the bottom illustration of FIG. 8*a*, this profile being capable of being transferred not only to the transversely extending projection 20, but also to the other projections, provided that they have been shaped as pre-forms in the previous operation. In this way, it can be realized that a scoring operation, which subjects the sheet metal to severe stress, is not performed at the same time as the shaping of the pre-form takes place in said first operation, said shaping considerably stressing the sheet metal lid. The score line may be introduced simultaneously with the re-forming operation. During re-forming—as is shown in FIG. 8*a*—the wall thickness on the top side of the projection is reduced by about 10% to 15%, with simultaneous compression and solidification of the same portion, which is achieved uniformly from top to bottom by the embossing operation (coining).

Further embodiments of projections are evident from the other figures. Thus, FIG. 6 shows an attachment of two substantially punctiform projections 23*a*, 23*b* to the longitudinal sides 31*a*, 31*b* of the attaching portion 31. Additionally or alternatively thereto, a projection 22 may be provided on a transverse edge 31*c* of the attaching portion 31. Said projection 22 may be elongated to oval and also substantially circular in shape.

FIG. 7 illustrates a group of projections that are assigned to a single outer edge (outwardly facing peripheral line) of the attaching portion 31. Said group 24—in this case—comprising three individual, substantially punctiform projections is assigned to the peripheral edge 31*c*, but may as well be assigned to the two other peripheral edges 31*a* and 31*b*. Also, only two punctiform projections can be used in FIG. 7. In the same way, the asymmetrical shape of the projections formed to protrude in upward direction in accordance with FIG. 4*a*, or also FIG. 5*a* or 8*a*, may also be applied to said embodiments.

If the at least one projection is associated with a peripheral edge 31*c* extending transversely to the longitudinal plane 100 of the tab 30, a rotational movement in both directions can be prevented with only one projection, if said projection extends at least on both sides of the midplane. On the other hand, if a projection is selected that is assigned to a peripheral edge extending parallel to the longitudinal plane 100, at least two projections have to be provided on two correspondingly available edges as "stop edges", for symmetrically limiting rotational movements of the tab 30.

All the projections described are arranged outside the attaching portion 30, in order to be able to cooperate in a blocking manner with at least one of its respective outer peripheral edges (edge).

The effect of the turning moments or torques is illustrated in FIGS. 9*a* and 9*b*. Said figures assume in a view from above onto the attaching portion 31 that said attaching portion is disposed on the panel 10 over a mounting place 11 (typically a rivet head). A lateral projection 21*a* extending parallel to the midplane 100 of the tab (tab 30) is shown schematically, upon which projection a force is exerted by an assumed rotation in a direction $\alpha$. For an assumed length l of the attaching portion 31, the mounting place 11 is located closer to the articulation line 38 than to the rear end 31*c* of the attaching portion 31, so that an effective power arm $l_1$ is larger than half of the length l of the attaching portion 31. Due to the positioning of the line- or strip-shaped projection 21*a* close to the rear edge line 31*c*, a force via a large lever arm can apply a large torque for blocking (blocking moment) an undesired rotation.

Similarly, the exertion of torques may be explained for a projection 20 that extends perpendicularly to a midplane 100, said projection occupying substantially the entire width b of the attaching portion 31 near to a rear edge line 31*c* thereof. In this case, the (maximum) power arm is designated b1, and in a first approximation, said lever arm is not exactly but largely equal to half of the width b, marked as lever arm $b_1$ in an assumed (hypothetical) rotational movement in a direction $\alpha$ as illustrated. The corresponding force via the lever arm b1 is applied by the projection 20, and the front edge 20*a* thereof (edge 20" in FIG. 4). The corner of the attaching portion 31 being slightly rounded, the entire half of the width is not available for use as a lever arm, but instead between 70% and 100% of b/2, substantially in the range of between 80% and 90%.

FIG. 10 illustrates a thinned zone of the sheet metal lid around a rivet head 11, said zone being visible from the inside. Said rivet base zone 11*a* is a zone that remains on an outer side after the second re-forming of the rivet head 11, usually visibly by circular lines surrounding the centre of the rivet as mounting place 11. This "button coin area" cannot withstand strong stresses, since the sheet metal is reduced in thickness due to the rivet being shaped to protrude in outward direction. Projection 20, which occupies a surface area $f_{20}$, but is line- or strip-shaped, is mounted in the outer edge zone 11*b* of the rivet base, that is to say it is displaced far outside of the thin sheet metal zone that is susceptible to damages. The attaching portion 31 is marked—not to scale—by a dashed line to show the relative position of the "coin area". Alternatively or cumulatively to the projection 20 shown as being located at the rear edge 31*c*, the two lateral projections 21*a*, 21*b* may also be provided here, said projections then being positioned close to the peripheral zone of the rivet base and not displaced to the thinned out portion near the rivet head, which portion is susceptible to damages.

A more precise dimensioning of the surface areas shows that the strip-shaped projection 20 is situated at least partly outside the rivet base zone (coin area) and outside the outer peripheral portion 11*b* thereof. The outward displacement is equal to at least 40% of the surface portion $f_{20}$, which is no longer in the periphery 11*b* of the rivet base 11*a*, but outside thereof. This position and the position and extension of the coin area are easily visible from the inside of the sheet metal lid.

The invention claimed is:

1. A non-detachable metallic end closure with a permanently attached pull tab, comprising:

a center panel;

a seaming panel positioned on a peripheral edge of said center panel which is adapted for interconnection to a neck of a container;

a pull tab having a grip portion on one end and a nose portion on an opposite end and an attaching portion positioned therebetween;

a rivet operably interconnecting said attaching portion of said pull tab to said center panel, wherein said pull tab has a first position prior to opening which is substantially parallel to a horizontal plane of said center panel, and a second position of opening wherein said pull tab is aligned substantially perpendicular to said horizontal plane of said central panel after fully opening a tear panel provided on said center panel;

at least one projection integrally formed in said center panel and extending upwardly therefrom, said at least one projection positioned substantially adjacent to an edge of said attaching portion to prevent rotation of said pull tab and said attachment portion when the pull tab is in both the first position and said second position; and wherein the at least one projection has an asymmetrical shape with variable steep flanks that are non parallel to each other.

2. The non-detachable metallic end closure of claim 1, wherein the at least one projection extends over at least 50% of a width of the attaching portion.

3. The non-detachable metallic end closure of claim 1, wherein said at least one projection is positioned proximate to one or more edges of the attaching portion.

4. The non-detachable metallic end closure of claim 1, wherein said at least one projection has a linear geometric shape.

5. The non-detachable metallic end closure of claim 1, wherein at least one of said at least one projection has an oval shape or round geometric shape.

6. The non-detachable metallic end closure of claim 1, wherein the attaching portion is substantially rectangular in shape and includes at least three outer edge portions which may engage said at least one projection.

7. The non-detachable metallic end closure of claim 1, wherein the attaching portion is connected to an articulation line on said pull tab wherein the pull tab is tiltable around the attaching portion when actuating the grip portion.

8. The non-detachable metallic end closure of claim 1, wherein the prevention of rotation of said pull tab and said attachment portion is maintained between the first position and the second position.

9. The non-detachable metallic end closure of claim 1, wherein the at least one projection has an asymmetrical shape with variable steep flanks or sides that are non parallel to each other.

10. A non-detachable metallic lid interconnected to a can body, the lid comprising:

a central panel including a score panel having a weakening line defining an openable area;

a non-removable pull tab including a grip portion, an opening portion and an attaching portion positioned therebetween, wherein the pull tab is initially oriented in a first position which is substantially parallel with respect to the central panel;

a rivet which is operably connected to said attaching portion of said pull tab wherein the pull tab can be pivoted between the first position and a second position of opening, wherein the pull tab is oriented between about 45-90 degrees with respect to the horizontal plane of the central panel;

the central panel comprising at least one strip-shaped projection resulting from an initial pre-forming from the panel and is structured and arranged in a final shape by a reforming, whereby the thickness of a top side of the strip-shaped projection is flattened and stiffened, and a first flank of the strip-shaped projection is shaped more steeply than a second flank of the projection during reforming to provide enhanced strength characteristics of said metallic lid;

wherein the at least one strip-shaped projection has an asymmetrical shape with variable steep flanks that are non parallel to each other;

the first flank of the strip-shaped projection being structured and arranged for engagement with at least one edge of the attaching portion of the pull tab to substantially prevent a pivoting movement of the tab in both a first position of use and a second position of opening, and without overlapping any portion of the attaching portion.

11. The non-detachable metallic lid of claim 10, wherein the at least one strip shaped projection has a height of at least 0.012 inches as measured from a top side facing outwards of the panel around the projection.

12. The non-detachable metallic lid of claim 10, wherein the height of the at least one strip shaped projection is not less than substantially the thickness of the sheet metal at a respective outer edge portion of the attaching portion.

13. The non-detachable metallic lid of claim 10, wherein the at least one strip shaped projection is located in a peripheral area of a rivet base zone in the lid, such that the rivet base zone is visible from an inside or a product side.

14. The non-detachable metallic lid of claim 10, wherein a part of the strip shaped projection is located outside the rivet base zone.

15. The non-detachable metallic lid of claim 10, wherein more than 40% of a surface area of the at least one strip shaped projection is located outside the rivet base zone.

16. The non-detachable metallic lid of claim 10, wherein the rivet base zone extends as a mounting place annularly about a rivet, which is visible from the inside or the product side.

17. The non-detachable metallic lid of claim 10, wherein the at least one strip shaped projection is positioned as a secant to a tangent as a strip or a line in a edge portion of the rivet base zone.

18. The non-detachable metallic lid of claim 10, wherein the at least one strip shaped projection has the length of more than 80% of the width of the attaching portion.

19. The non-detachable metallic lid of claim 10, wherein the at least one strip shaped projections are located near at least one portion of two or more edges of the attaching portion.

20. The non-detachable metallic lid of claim 10, wherein the at least one strip shaped projection extends in a longitudinal direction of the tab and has a length that is not more than 50% of a longitudinal extension of the attaching portion, and in combination with a distance of the outermost end of the at least one projection from a center of the mounting place of the more than 50% of the longitudinal extension of the attaching portion.

21. The non-detachable metallic lid of claim 10, wherein the at least one strip shaped projection comprises at least three projections, two of which extend substantially parallel to a longitudinal axis of the non-removable pull tab and one extending substantially perpendicular to the axis of the non-removable pull tab.

* * * * *